US010775075B2

(12) United States Patent
Taguchi et al.

(10) Patent No.: US 10,775,075 B2
(45) Date of Patent: Sep. 15, 2020

(54) FLUID HEATER

(71) Applicant: HORIBA STEC, Co., Ltd., Kyoto-shi, Kyoto (JP)

(72) Inventors: Akihiro Taguchi, Kyoto (JP); Masashi Hamada, Kyoto (JP); Hidetaka Yada, Kyoto (JP)

(73) Assignee: HORIBA STEC, Co., Ltd., Kyoto-shi, Kyoto (JP)

( * ) Notice: Subject to any disclaimer, the term of this patent is extended or adjusted under 35 U.S.C. 154(b) by 65 days.

(21) Appl. No.: 14/954,688

(22) Filed: Nov. 30, 2015

(65) Prior Publication Data

US 2016/0178235 A1 Jun. 23, 2016

(30) Foreign Application Priority Data

Dec. 22, 2014 (JP) ..... 2014-259533

(51) Int. Cl.
*F24H 1/14* (2006.01)

(52) U.S. Cl.
CPC ..... *F24H 1/142* (2013.01)

(58) Field of Classification Search
CPC ..... F24H 1/142; F24H 1/121; F24H 392/484; F24H 392/491; F24H 392/494; F24H 219/517; F24H 239/135; H05B 3/00
USPC ..... 392/484, 491, 494; 219/517; 239/135
See application file for complete search history.

(56) References Cited

U.S. PATENT DOCUMENTS 1,355,838 A * 10/1920 McLean ..... F24H 1/102 222/146.3
1,671,677 A * 5/1928 Keeton ..... F24H 1/142 392/489
2,294,578 A * 9/1942 Shapiro ..... D06F 75/12 38/77.6

(Continued)

FOREIGN PATENT DOCUMENTS

CN 1216356 A 5/1999
CN 1754983 A 4/2006

(Continued)

OTHER PUBLICATIONS

State Intellectual Property Office of the People's Republic of China, Office Action and Search Report Issued in Application No. 201510829711.4, dated May 10, 2019, 13 pages.

(Continued)

*Primary Examiner* — Eric S Stapleton
(74) *Attorney, Agent, or Firm* — Alleman Hall Creasman & Tuttle LLP

(57) ABSTRACT

The present invention is a fluid heater that can easily be reduced in size, that can be manufactured inexpensively, and that provides a stable heating performance. This fluid heater heats a fluid using a heater, and is provided with a heating block in which an internal flow path having an intake port through which the fluid is introduced, and a discharge port through which the fluid is discharged is formed, and in which a heater insertion portion that extends in a predetermined axial direction is formed, wherein the internal flow path has a plurality of main flow path portions that extend in the predetermined axial direction, and one or a plurality of connecting path flow portions that connect the plurality of main flow path portions together.

6 Claims, 3 Drawing Sheets

(56) References Cited

U.S. PATENT DOCUMENTS 2,412,737 A * 12/1946 Kercher ..... H05B 1/0205 219/512
2,576,558 A * 11/1951 Bede ..... H05B 3/00 165/11.1
2,673,920 A * 3/1954 Donovan ..... A47J 31/542 165/185
2,775,683 A * 12/1956 Kleist ..... F25B 43/00 222/146.3
2,856,759 A * 10/1958 Barbulesco ..... F25B 41/062 236/92 B
2,866,885 A * 12/1958 McIlrath ..... F24H 1/162 219/509
3,096,426 A * 7/1963 Axelson ..... B05B 7/1646 219/521
3,250,723 A * 5/1966 Fortney ..... A01G 13/06 239/133
3,475,916 A * 11/1969 Sidney ..... F17C 7/04 122/33
3,566,615 A * 3/1971 Roeder, Jr. ..... F25B 41/067 165/156
3,584,194 A * 6/1971 Kautz ..... B05B 9/002 165/156
3,614,385 A * 10/1971 Horstmann ..... A61M 5/44 165/104.19
3,665,156 A * 5/1972 Lee ..... H01H 35/30 137/202
3,676,642 A * 7/1972 Rosen ..... F28F 3/12 165/168
3,782,456 A * 1/1974 Gusmer ..... F28D 7/0041 165/164
3,835,294 A * 9/1974 Krohn ..... H05B 3/00 219/517
3,854,032 A * 12/1974 Cooper ..... H05B 7/18 219/121.11
3,890,086 A * 6/1975 Miyahara ..... F23D 11/04 239/214.11
3,964,859 A * 6/1976 Nishi ..... F23D 11/00 236/15 BD
4,022,281 A * 5/1977 Pennock ..... E21B 23/02 166/341
4,032,070 A * 6/1977 Nielsen ..... F25B 41/062 137/503
4,041,276 A * 8/1977 Schwarz ..... A61C 19/00 219/501
4,055,220 A * 10/1977 Stelwagen ..... D01D 10/0445 165/86
4,199,675 A * 4/1980 Sharpless ..... F24H 1/121 137/341
4,230,935 A * 10/1980 Meixner ..... H01C 7/022 219/441
4,255,646 A * 3/1981 Dragoy ..... F17C 7/04 137/341
4,319,126 A * 3/1982 Lujic ..... H01H 37/002 219/494
4,327,282 A * 4/1982 Nauerth ..... H05B 3/10 219/505
4,334,141 A * 6/1982 Roller ..... A47J 31/545 219/505
4,343,988 A * 8/1982 Roller ..... A47J 31/545 165/165
4,346,285 A * 8/1982 Nakamura ..... F24H 1/121 165/181
4,371,777 A * 2/1983 Roller ..... F24H 1/142 219/505
4,394,639 A * 7/1983 McGalliard ..... H01H 85/046 337/292
4,399,349 A * 8/1983 Deming ..... A45D 19/16 128/203.17
4,459,465 A * 7/1984 Knight ..... F24H 9/2028 219/486
4,465,458 A * 8/1984 Nishino ..... F23D 11/448 261/107
4,465,922 A * 8/1984 Kolibas ..... F24H 1/121 165/156
4,480,172 A * 10/1984 Ciciliot ..... F22B 1/288 165/140
4,483,304 A * 11/1984 Yokoi ..... F02M 31/135 123/549
4,535,836 A * 8/1985 Thomas ..... F28D 11/02 165/86
4,571,079 A * 2/1986 Knollenberg ..... G01N 21/53 356/336
4,625,910 A * 12/1986 Kawamura ..... B60H 1/2212 123/551
4,645,904 A * 2/1987 Moraski ..... F17C 7/04 392/401
4,713,524 A * 12/1987 Leo ..... F02M 31/125 123/549
4,797,089 A * 1/1989 Schubach ..... F23D 11/44 431/208
4,811,720 A * 3/1989 Katumata ..... F02M 31/125 123/527
4,814,584 A * 3/1989 Bohlender ..... H05B 3/14 219/505
4,874,924 A * 10/1989 Yamamoto ..... A01M 1/2077 392/391
4,877,395 A * 10/1989 Schubach ..... F23D 11/44 431/208
4,898,142 A * 2/1990 Van Wechem ..... F02M 53/06 123/549
4,903,850 A * 2/1990 Frank ..... A61M 16/16 392/403
4,975,559 A * 12/1990 Frisch ..... A47J 31/0573 392/449
5,005,370 A * 4/1991 Tanaka ..... F25B 41/062 62/211
5,057,672 A * 10/1991 Bohlender ..... F24H 3/0405 219/202
5,171,613 A * 12/1992 Bok ..... B01F 5/0619 118/667
5,182,942 A * 2/1993 Hartel ..... F02D 19/0605 123/1 A
5,214,740 A * 5/1993 Carroll ..... B05B 7/162 239/135
5,245,693 A * 9/1993 Ford ..... A61M 5/44 165/169
5,265,318 A * 11/1993 Shero ..... B23P 11/025 15/321
5,381,510 A * 1/1995 Ford ..... A61M 5/44 165/169
5,400,969 A * 3/1995 Keene ..... B05B 1/24 219/205
5,401,935 A * 3/1995 Smith ..... F02M 57/00 219/206
5,539,857 A * 7/1996 McGrevy ..... B29C 45/2738 219/536
5,549,559 A * 8/1996 Eshel ..... A61B 18/08 604/113
5,609,297 A * 3/1997 Gladigow ..... F02M 31/125 123/298
5,644,866 A * 7/1997 Katsuda ..... A01M 1/2077 238/56
D388,161 S * 12/1997 Thweatt ..... F02M 31/125 D23/314
5,796,914 A * 8/1998 Gatzemeyer ..... A01M 1/2077 392/390
D398,042 S * 9/1998 Thweatt ..... F02M 31/125 D23/314
5,825,975 A * 10/1998 Privas ..... B05B 7/1686 222/146.5
5,870,524 A * 2/1999 Swiatosz ..... F41H 9/06 392/394
5,873,354 A * 2/1999 Krohn ..... F02M 31/125 123/549
5,947,091 A * 9/1999 Krohn ..... F02M 31/12 123/549
5,957,384 A * 9/1999 Lansinger ..... B60S 1/481 219/202

(56) References Cited

U.S. PATENT DOCUMENTS 5,966,499 A * 10/1999 Hinkle ..... B01J 4/00 118/715
5,995,711 A * 11/1999 Fukuoka ..... B60H 1/00328 219/202
6,005,228 A * 12/1999 Dickens ..... G05D 23/1919 219/483
6,037,567 A * 3/2000 Inoue ..... B60H 1/2225 165/299
6,044,825 A * 4/2000 Carter ..... F02M 21/06 123/557
6,058,915 A * 5/2000 Abidin ..... F02M 31/18 123/546
6,076,359 A * 6/2000 Jurcik ..... F17C 7/04 219/201
6,124,570 A * 9/2000 Ebner ..... B60H 1/00328 219/202
6,131,237 A * 10/2000 Kasper ..... A47L 5/225 15/320
6,157,774 A * 12/2000 Komino ..... B01F 3/04049 239/423
6,162,046 A * 12/2000 Young ..... F23D 3/02 126/45
6,343,416 B1 * 2/2002 Miller ..... F25C 1/147 29/890.035
RE37,704 E * 5/2002 Eshel ..... A61B 18/08 604/113
6,455,822 B1 * 9/2002 Chang ..... H05B 3/14 165/185
6,461,148 B1 * 10/2002 Scotto ..... F23D 11/24 126/91 A
6,601,776 B1 * 8/2003 Oljaca ..... B05B 1/24 239/128
6,941,064 B2 * 9/2005 Thweatt, Jr. ..... A47L 11/34 15/320
6,944,394 B2 * 9/2005 Long ..... F24H 9/2028 392/465
6,957,013 B2 * 10/2005 Zimmer ..... B01D 1/0017 392/397
6,968,125 B1 * 11/2005 Garber ..... F24H 1/102 392/492
6,968,688 B2 * 11/2005 Gimsa ..... F02G 1/043 417/379
7,065,292 B2 * 6/2006 Thweatt, Jr. ..... H05B 3/78 219/546
7,248,792 B2 * 7/2007 Mihara ..... F24H 1/162 392/465
7,297,324 B2 * 11/2007 TeGrotenhuis ..... B01B 1/005 423/352
7,471,882 B2 * 12/2008 Peebles ..... F24H 1/102 392/311
7,481,205 B2 * 1/2009 Keeler ..... F02D 41/064 123/549
7,667,166 B2 * 2/2010 Zeyen ..... F24H 3/0405 165/175
7,756,404 B2 * 7/2010 Schubert ..... F28D 7/026 392/478
7,801,424 B2 * 9/2010 Cheung ..... A61H 33/063 392/385
7,916,293 B2 * 3/2011 Mitchell ..... G01N 15/1459 356/336
7,936,982 B2 * 5/2011 Milli ..... B05B 7/162 392/449
7,977,606 B2 * 7/2011 Adachi ..... H05B 3/50 219/202
8,165,461 B2 * 4/2012 Sullivan ..... F24H 1/142 392/465
8,170,406 B2 * 5/2012 Wu ..... B60S 1/487 392/465
8,180,207 B2 * 5/2012 Shirai ..... E03D 9/08 392/465
8,183,503 B1 * 5/2012 Gupta ..... F24H 9/1827 219/482
8,214,936 B2 * 7/2012 Thweatt, Jr. ..... F28D 7/0066 4/493
8,350,193 B2 * 1/2013 Lu ..... H05B 3/42 219/429
8,550,147 B2 * 10/2013 Lansinger ..... B60H 1/00271 165/141
8,586,895 B2 * 11/2013 Haeberer ..... F01N 3/2066 219/202
8,666,235 B2 * 3/2014 Powell ..... F23D 11/448 122/4 D
8,724,978 B2 * 5/2014 Furumura ..... F22B 1/28 392/484
8,917,981 B2 * 12/2014 Trebouet ..... B60S 1/487 392/465
8,948,582 B2 * 2/2015 Kominami ..... F24H 9/20 165/175
9,234,677 B2 * 1/2016 Clade ..... F24H 3/0405
2001/0039684 A1 * 11/2001 Kasper ..... A47L 5/30 8/147
2004/0131344 A1 * 7/2004 Zimmer ..... B01D 1/0017 392/397
2004/0173345 A1 * 9/2004 Belady ..... F28F 13/00 165/185
2005/0022333 A1 * 2/2005 McDowell ..... A47L 5/30 15/320
2008/0193112 A1 * 8/2008 Whyatt ..... F23D 11/448 392/399
2009/0097831 A1 4/2009 Nishikawa et al.
2011/0059409 A1 * 3/2011 Powell ..... F23D 11/448 431/161
2012/0070134 A1 * 3/2012 Durisek ..... A61L 9/03 392/386
2013/0161308 A1 * 6/2013 Bohlender ..... H05B 3/02 219/202

FOREIGN PATENT DOCUMENTS

| | | | |
|---|---|---|---|
| CN | 101410548 | A | 4/2009 |
| EP | 1529470 | B2 | 12/2010 |
| JP | 30001893 | B | 3/1955 |
| JP | 50121354 | U | 3/1975 |
| JP | 56140044 | U | 3/1980 |
| JP | 2002090077 | A | 3/2002 |
| JP | 2003273026 | A | 9/2003 |
| WO | 2012157852 | A2 | 11/2012 |

OTHER PUBLICATIONS

Japan Patent Office, Office Action Issued in Application No. 2015249100, dated Aug. 22, 2019, 18 pages.

* cited by examiner

FLUID HEATER

The present invention relates to a fluid heater that heats a fluid such as a liquid material that serves as the raw material of a gas that is used, for example, in a semiconductor manufacturing process.

TECHNICAL BACKGROUND

Conventionally, a vaporization system that vaporizes a liquid material is used to create the gas that is used in a semiconductor manufacturing process such as, for example, a film formation process or the like.

In this vaporization system, as is shown, for example, in Patent document 1, a heater that is constructed by forming the conduits along which the fluid flows, and also the heating apparatus that heats these conduits from cast aluminum is used for a vaporizer that vaporizes a liquid material by heating it, and also for a preheater and the like that preheats the liquid material that is introduced into that vaporizer.

However, when the conduits and heater are formed by casting, it is difficult to reduce their size, and they are also expensive to produce. Moreover, because irregularities in the casting give rise to changes in the thermal conductivity of the conduits and heater, it is difficult, in some cases, to obtain a satisfactory heating performance.

DOCUMENTS OF THE PRIOR ART

Patent Documents

[Patent document 1] Japanese Unexamined Patent Application (JP-A) No. 2002-90077

DISCLOSURE OF THE INVENTION

Problems to be Solved by the Invention

The present invention was therefore conceived in order to solve the above-described problems, and it is a principal object thereof to provide a fluid heater that can be easily reduced in size, that can be manufactured cheaply, and that provides a stable heating performance.

Means for Solving the Problem

Namely, the fluid heater according to the present invention is a fluid heater that heats a fluid using a heater, and that includes: a heating block in which an internal flow path having an intake port through which the fluid is introduced, and a discharge port through which the fluid is discharged is formed by machining, and in which a heater insertion portion that extends in a predetermined axial direction is formed, wherein the internal flow path has a plurality of main flow path portions that extend in the predetermined axial direction, and one or a plurality of connecting path flow portions that connect the plurality of main flow path portions together, and wherein the plurality of main flow path portions are provided so as to surround the heater insertion portion.

If this type of structure is employed, then because the internal flow path is formed in the heating block by machining, it can easily be reduced in size, and can be manufactured inexpensively. Moreover, because there are few manufacturing irregularities, unlike the case with conventional casting, it is possible to obtain a stable heating performance. In particular, because the internal flow path has the plurality of main flow path portions that extend in the axial direction of the heater insertion hole, it is possible to effectively utilize the heat from the heater to heat the fluid.

It is desirable that, as a result of the one or plurality of the connecting flow path portions connecting together end portions in a longitudinal direction of the plurality of main flow path portions, the internal flow path be formed as a flow path that turns back on itself a plurality of times between the intake port and the discharge port.

If this type of structure is employed, it becomes possible to increase the flow path length of the internal flow path inside the heating block, and to enlarge the heat exchange area where heat is exchanged with the fluid, and to thereby improve the heating performance.

It is also desirable for either at least one main flow path portion (hereinafter, this will be referred to as a midstream main flow path portion) other than the most upstream side main flow path portion, which is closest to the intake port, and the most downstream side main flow path portion, which is closest to the discharge port, or else the heater insertion portion to be positioned between the most upstream side main flow path portion and the most downstream side main flow path portion.

If this type of structure is employed, because either at least one midstream main flow path portion, or else the heater insertion portion is positioned between the most upstream side main flow path portion through which the comparatively low-temperature fluid flows during the initial heating stage, and the most downstream side main flow path portion through which the comparatively high-temperature fluid flows during the final stages of heating, it is possible to prevent the fluid flowing through the most downstream side main flow path portion being cooled by the fluid flowing through the most upstream side main flow path portion.

It is also desirable for the discharge port to be formed above the intake port, and for the internal flow path to be formed so as to either extend in a horizontal direction, or so as to slope upwards as it moves towards the downstream side between the intake port and the discharge port.

If this type of structure is employed, any air bubbles that are contained in the fluid flowing through the internal flow path do not become trapped inside the internal flow path, but are instead discharged from the discharge port together with the fluid that is flowing through the internal flow path. As a consequence of this, the fluid flowing through the internal flow path can be efficiently heated. Moreover, if the air bubbles end up growing so as to form a large air bubble, and this large air bubble is pushed towards the downstream side, then this affects the supply rate control by the supply rate controller, however, this is prevented by the above-described structure.

It is also desirable for the above-described predetermined axial direction to be a horizontal direction, and for the one or plurality of connecting flow paths portions to be formed sloping upwards towards the downstream side.

If this type of structure is employed, then because the main flow path portions extend in a horizontal direction, and the one or plurality of connecting flow path portions are formed sloping upwards, any air bubbles contained in the fluid flowing through the internal flow path are discharged from the discharge port.

It is also desirable for the heating block to have a generally column-shaped configuration, and for one of the main flow path portions to open onto one end surface in the longitudinal direction of the heating block so as to form the intake port, and for another one of the main flow path portions to open onto the same one end surface in the longitudinal direction so as to form the discharge port.

If this type of structure is employed, it is possible to form the intake port and the discharge port simply by forming the main flow path portions in the heating block by machining, so that the manufacturing is simplified. Moreover, by forming the intake port and the discharge port in the same one end surface in the longitudinal direction of the heating block, the internal flow path in the manifold block can be joined to the internal flow path in the heating block simply by mounting the one end surface in the longitudinal direction of the heating block onto the manifold block, so that the need for a conduit structure is eliminated.

Effects of the Invention

According to the present invention which has the above-described structure, because an internal flow path is formed by machining in a heating block, the size of the fluid heater can easily be reduced, and the fluid heater can also be manufactured cheaply. Moreover, because manufacturing irregularities such as those produced by conventional casting are decreased, a stable heating performance can be achieved.

BEST EMBODIMENTS FOR IMPLEMENTING THE INVENTION

Hereinafter, an embodiment of a vaporization system according to the present invention will be described with reference made to the drawings.

Figure 1:
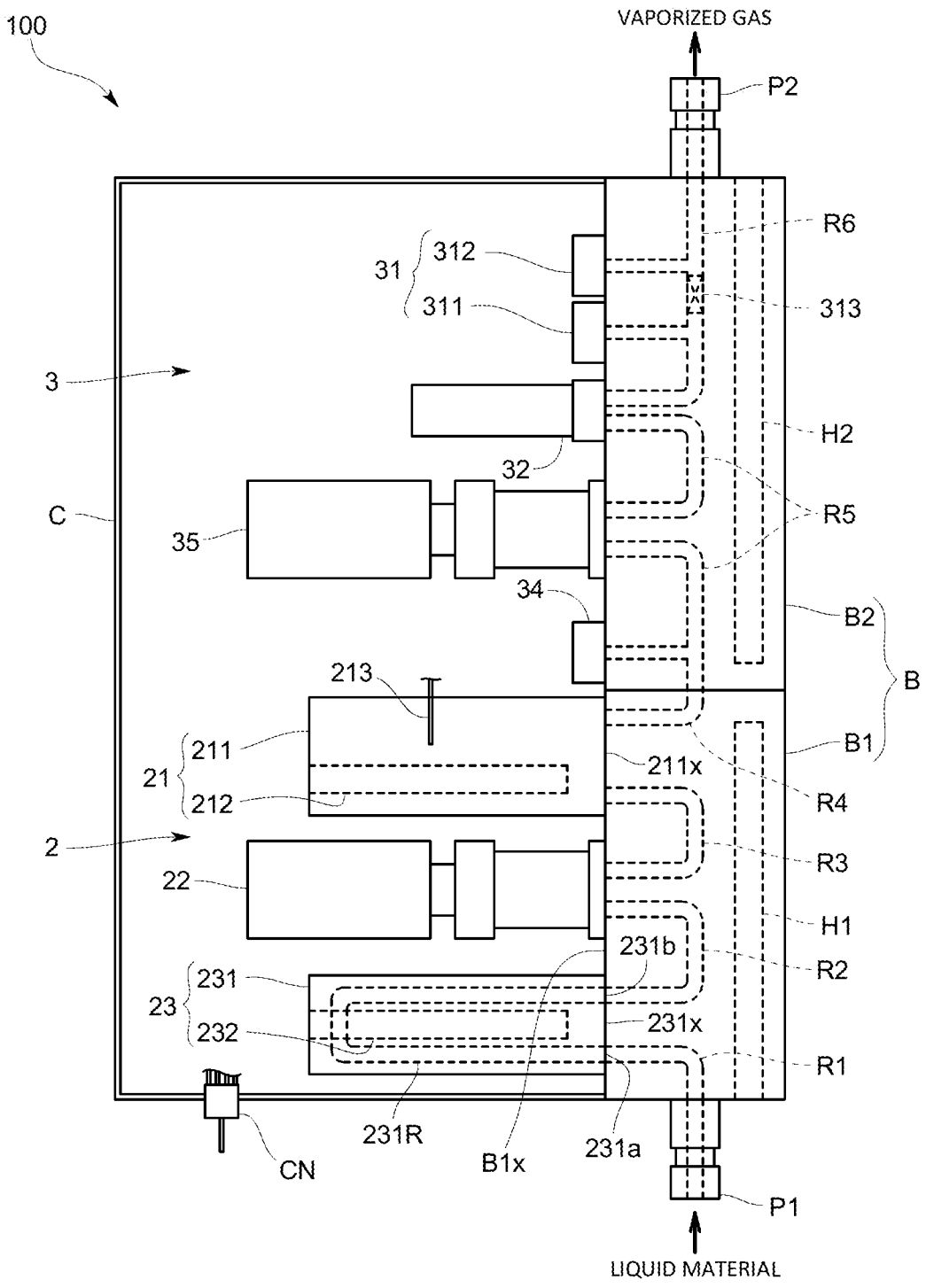
FIG. 1 is a typical view showing the structure of a vaporization system according to the present embodiment.

A vaporization system 100 of the present embodiment is used to supply gas at a predetermined flow rate to a chamber that is incorporated, for example, on a semiconductor manufacturing line or the like, and is where a semiconductor manufacturing process is performed. As is shown in FIG. 1, the vaporization system 100 is equipped with a vaporization unit 2 that vaporizes a liquid raw material, and a mass flow controller 3 that controls the flow rate of the gas that is vaporized by this vaporization unit 2.

The vaporization unit 2 is provided with a vaporizer 21 that vaporizes a liquid material using a baking method, a supply rate controller 22 that controls the supply rate of the liquid material to the vaporizer 21, and a preheater 23 that preheats the liquid material supplied to the vaporizer 21 to a predetermined temperature.

The vaporizer 21, the supply rate controller 22, and the preheater 23 are mounted on a device mounting surface B1*x* that is set on one surface of a body block B1 (hereinafter, this is referred to as a first body block B1) that has an internal flow path formed inside it. Here, the first body block B1 is made from a metal such as, for example, stainless steel or the like, and has the general outline of an elongated column (specifically, the general outline of a rectangular parallelepiped). The aforementioned device mounting surface B1*x* is an elongated rectangular surface. Note that the first body block B1 of the present embodiment is installed on a semiconductor manufacturing line or the like such that the longitudinal direction thereof is aligned in an up-down direction (i.e., in a vertical direction).

Specifically, the preheater 23, the supply rate controller 22, and the vaporizer 21 are mounted on a straight line that extends in the longitudinal direction on the device mounting surface B1*x*. Moreover, the preheater 23, the supply rate controller 22, and the vaporizer 21 are connected together in series in this sequence from the upstream side by internal flow paths (R1~R4) that are formed in the first body block B1. Note also that a heater H1 that is used to heat the liquid material flowing through the internal flow paths (R1~R4) is also provided inside the first body block B1. Moreover, an aperture on the upstream side of the internal flow path R1 in the first body block B1 is connected to a liquid material intake port P1 that is provided in a surface at one end in the longitudinal direction of the first body block B1.

The vaporizer 21 has a storage vessel 211 in the form of a vaporization tank that has an internal space for storing a liquid material, and a vaporizer heater 212 that is provided in the storage vessel 211 and is used to vaporize the liquid material.

The storage vessel 211 has a mounting surface 211*x* that is mounted on the device mounting surface B1*x* of the first body block B1. The storage vessel 211 of the present embodiment has the general outline of, for example, an elongated column, and a surface at one end in the longitudinal direction thereof serves as the mounting surface 211*x*. Specifically, the storage vessel 211 has the general outline of a rectangular parallelepiped. Moreover, the storage vessel 211 of the present embodiment is installed on a semiconductor manufacturing line or the like such that the longitudinal direction thereof is aligned in a horizontal direction.

An intake port that is used to introduce a liquid material from the internal flow path R3 in the first body block B1, and a discharge port that is used to discharge vaporized gas into the internal flow path R4 in the first body block B1 are formed in the mounting surface 211*x*. Moreover, by mounting the mounting surface 211*x* of the storage vessel 211 on the device mounting surface B1*x* of the first body block B1, the intake port formed in the mounting surface 211*x* is able to communicate with the aperture of the internal flow path R3 (i.e., the aperture on the downstream side) that is formed in the device mounting surface B1*x*, and the discharge port formed in the mounting surface 211*x* is able to communicate with the aperture of the internal flow path R4 (i.e., the aperture on the upstream side) that is formed in the device mounting surface B1*x*.

A liquid level sensor 213 that is used to detect the storage volume of the stored liquid material is also provided in the storage vessel 211. In the present embodiment, the liquid level sensor 213 is inserted into the interior through the top wall of the storage vessel 211.

The vaporizer heater 212 is inserted through a wall portion (for example, a bottom wall portion) of the storage vessel 211. Specifically, the vaporizer heater 212 is inserted (in the longitudinal direction) towards the first body block B1 from the surface on the opposite side from the mounting surface 211*x* (i.e., from the other end surface 231*c* in the longitudinal direction).

The supply rate controller 22 is a control valve that controls the flow rate of the supply of liquid material to the vaporizer 21, and, in the present embodiment, is a solenoid shut-off valve. This solenoid shut-off valve 22 is mounted such that it covers the aperture (i.e., the aperture on the downstream side) of the internal flow path R2 and the aperture (i.e., the aperture on the upstream side) of the internal flow path R3 that are formed in the device mounting surface B1*x* of the first body block B1. Specifically, a valve body (not shown) of the solenoid shut-off valve 22 is created such that it is able to either open up or block off the aperture (i.e., the aperture on the downstream side) of the internal flow path R2 and the aperture (i.e., the aperture on the upstream side) of the internal flow path R3 that are formed in the device mounting surface B1*x*.

In addition, a controller (not shown) controls the turning ON and OFF of the solenoid shut-off valve 22 based on detection signals from the liquid level sensor 213 provided in the storage vessel 211 such that the liquid material stored in the storage vessel 211 is kept constantly at a predetermined volume. By doing this, during a vaporization operation, the liquid material is supplied intermittently to the vaporizer 21. Here, if the supply flow rate of the liquid material is controlled by supplying it intermittently using ON/OFF control, then compared with when the supply flow rate of the liquid material is controlled continuously using a mass flow controller or the like, the size of the vaporizer unit 2 can be reduced.

The preheater 23 has a preheating block (i.e., a heating block) 231 that has an internal flow path 231R through which the liquid material is able to flow formed inside it by machining, and a preheating heater (i.e., a heating heater) 232 that is used to preheat the liquid material provided in this preheating block 231. The liquid material is heated by this preheater 23 to a temperature immediately prior to vaporization (i.e., to just less than boiling point).

The preheating block 231 has a mounting surface 231*x* that is mounted onto the first body block B1. The preheating block 231 of the present embodiment has the general outline, for example, of an elongated column, and one end surface in the longitudinal direction thereof serves as the mounting surface 231*x*. Specifically, the preheating block 231 has the general outline of a rectangular parallelepiped. Moreover, the preheating block 231 of the present embodiment is installed on a semiconductor manufacturing line or the like such that the longitudinal direction thereof is aligned in a horizontal direction.

Moreover, a heater insertion hole 231H is formed by mechanical processing in the preheating block 231. This heater insertion hole 231H is used to insert the preheating heater 232 in the longitudinal direction from a central portion of the other end surface 231*c* in the longitudinal direction of the preheating block 231. Specifically, the heater insertion hole 231H is a rectilinear flat-bottomed hole that extends in a predetermined axial direction (i.e., in a horizontal direction in the present embodiment), and is formed, for example, by cutting processing such as hole-boring processing or the like.

An intake port 231*a* that is used to introduce the liquid material from the internal flow path R1 in the first body block B1, and a discharge port 231*b* that is used to discharge the preheated liquid material into the internal flow path R2 in the first body block B1 are formed in the mounting surface 231*x*. Moreover, by mounting the mounting surface 231*x* of the preheating block 231 on the device mounting surface B1*x* of the first body block B1, the intake port 231*a* that is formed in the mounting surface 231*x* is able to communicate with the aperture of the flow path R1 (i.e., the aperture on the downstream side) that is formed in the device mounting surface B1*x*, and the discharge port 231*b* that is formed in the mounting surface 231*x* is able to communicate with the aperture of the flow path R2 (i.e., the aperture on the upstream side) that is formed in the device mounting surface B1*x*.

By inserting the preheating heater 232 into the heater insertion hole 231H that is formed in the preheating block 231, the preheating heater 232 is positioned so as to face the first body block B1 (in the longitudinal direction) from the surface of the preheating block 231 on the opposite side from the mounting surface 231*x* (i.e., from the other end surface 231*c* in the longitudinal direction).

Figure 2:
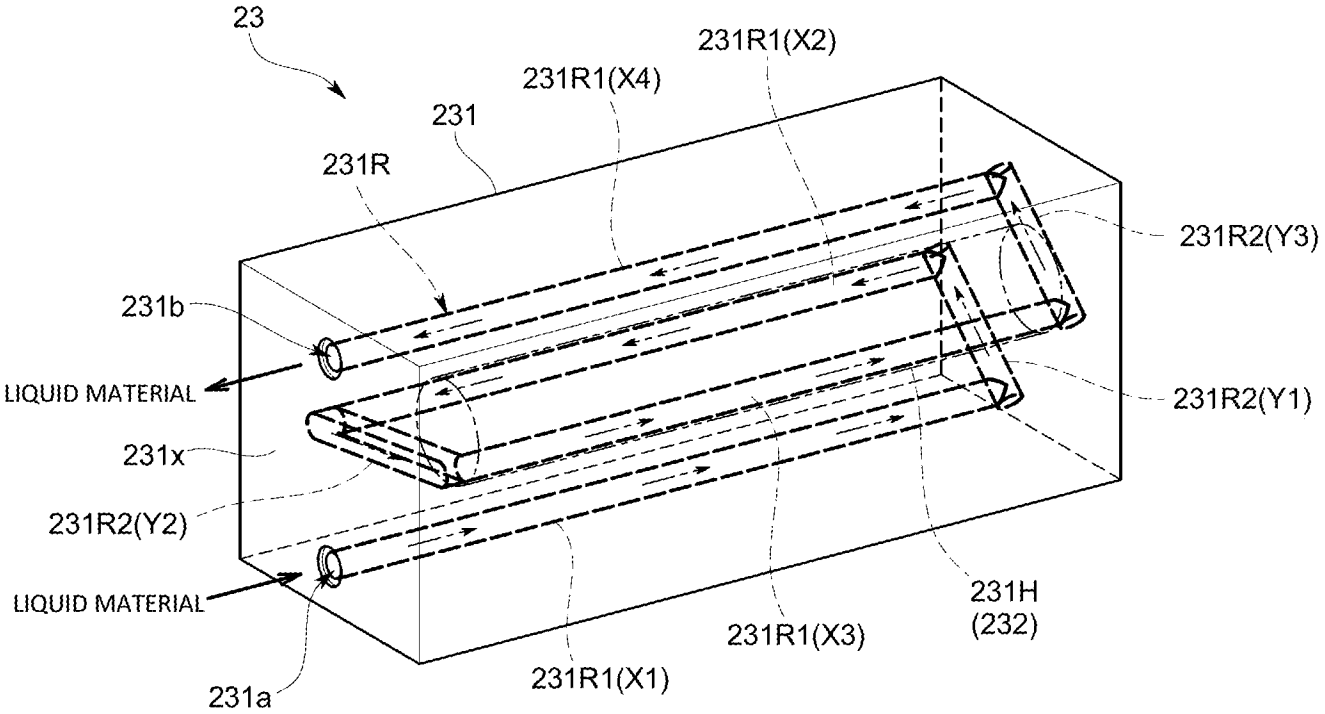
FIG. 2 is a perspective view of a preheater according to the same embodiment.
Figure 3:
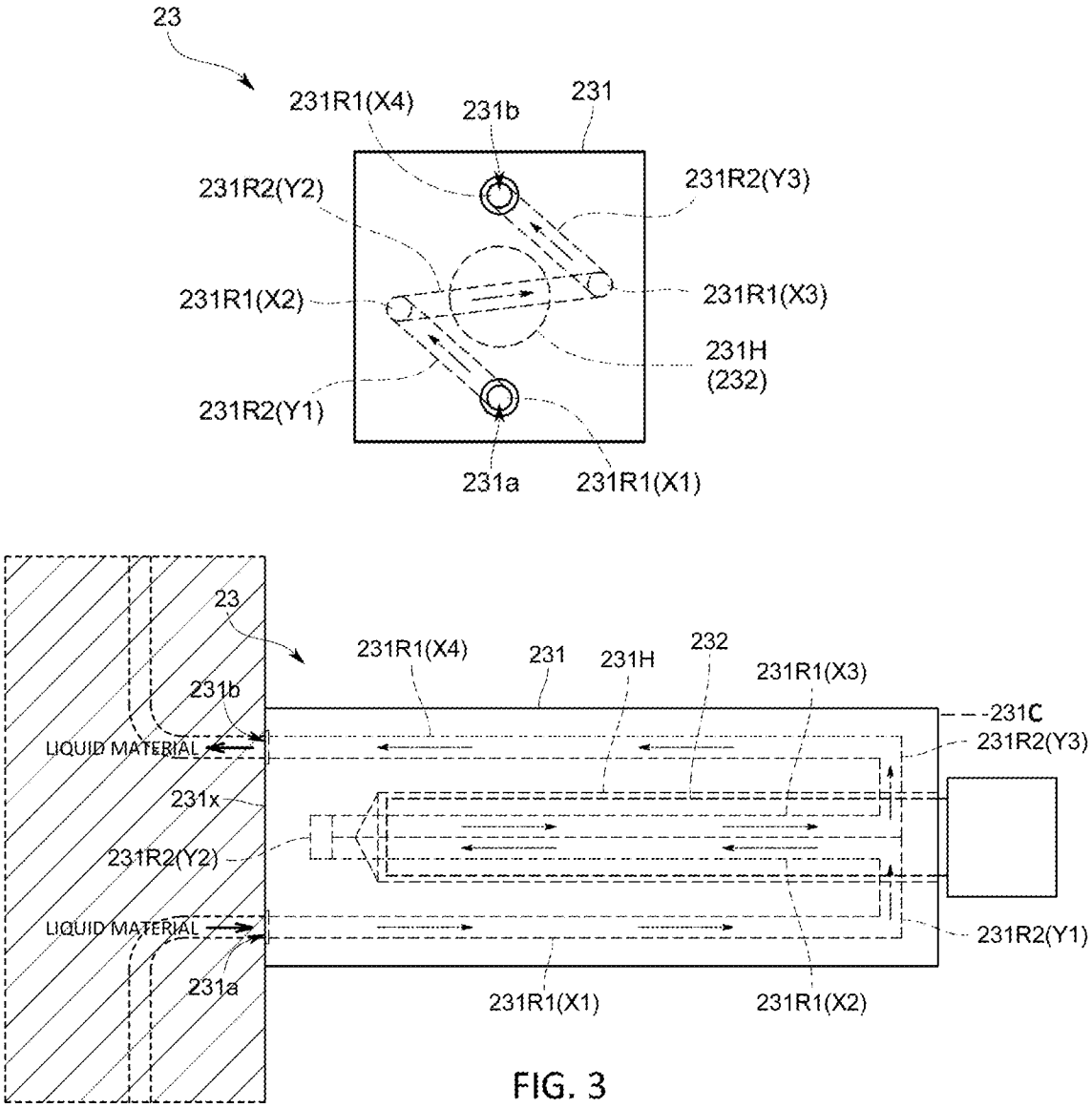
FIG. 3 shows a plan view as seen from a mounting surface of the preheater of the same embodiment, and also shows a side view thereof.

As is shown in FIG. 2 and FIG. 3, in particular, in the preheating block 231, the internal flow path 231R through which the liquid material flows has a plurality of longitudinal flow path portions (i.e., main flow path portions) 231R1 that extend in a predetermined axial direction (i.e., in a longitudinal direction), and either one or a plurality of connecting flow path portions 231R2 that connect together the plurality of longitudinal flow path portions 231R1.

The plurality of longitudinal flow path portions 231R1 are provided around the periphery of the heater insertion portion 231H so as to surround the heater insertion portion 231H. In the present embodiment, there are four longitudinal flow path portions 231R1 (X1~X4). These longitudinal flow path portions 231R1 have a rectilinear shape that extends substantially in parallel with the heater insertion hole 231H, and are formed by performing cutting processing such as, for example, hole-boring processing on the mounting surface 231*x* of the preheating block 231. Note that in the present embodiment, the longitudinal flow path portions 231R1 are provided so as to extend towards the other end side in the longitudinal direction beyond the distal end of the heater insertion hold 231H (see the side view in FIG. 3).

Moreover, the one or plurality of connecting flow path portions 231R2 connect together end portions in the longitudinal direction of mutually adjacent longitudinal flow path portions 231R1. In the present embodiment, because there are four longitudinal flow path portions 231R1, there are three connecting flow path portions 231R2 (Y1~Y3). These connecting flow path portions 231R2 have a rectilinear shape that extends in a perpendicular direction relative to the longitudinal direction. The connecting flow path portions 231R2 can be formed by performing cutting processing such as, for example, hole-boring processing on a side surface of the preheating block 231, and then blocking off the aperture portions formed in that side surface using a lid body (not shown). Alternatively, it is also possible to form a connecting flow path portion 231R2 that connects together two longitudinal flow path portions 231R1 by forming a recessed portion in an end surface in the longitudinal direction of the preheating block 231 such that the two longitudinal flow path portions 231R1 are opened up, and then blocking off this recessed portion using a lid body.

Accordingly, a reciprocating flow path that turns back on itself either once or a plurality of times between the one end and the other end in the longitudinal direction inside the preheating block 231 so as to surround the periphery of the preheating heater 232 is formed by the plurality of longitudinal flow path portions 231R1 and the plurality of connecting flow path portions 231R2. Specifically, as a result of the plurality of connecting flow paths 231R2 connecting together the end portions in the longitudinal direction of the plurality of longitudinal flow path portions 231R1, the internal flow path 231R is formed as a single flow path that extends from the intake port 231*a* to the discharge port 231*b*.

Furthermore, the intake port 231*a* is formed as a result of one of the longitudinal flow path portions 231R1 opening onto the one end surface 231*x* (i.e., the mounting surface) in the longitudinal direction of the preheating block 231. Namely, this particular longitudinal flow path portion 231R1

(X1) is the most upstream-side longitudinal flow path portion inside the preheating block 231.

The discharge port 231*b* is formed as a result of another one of the longitudinal flow path portions 231R1 opening onto the one end surface 231*x* (i.e., the mounting surface) in the longitudinal direction of the preheating block 231. Namely, this particular longitudinal flow path portion 231R1 (X4) is the most downstream-side longitudinal flow path portion inside the preheating block 231.

In addition, the discharge port 231*b* is formed above the intake port 231*a* in the one end surface 231*x* in the longitudinal direction of the preheating block 231. Specifically, the intake port 231*a* and the discharge port 231*b* are placed opposite each other on either side of the heater insertion hole 231H. Namely, the most upstream-side longitudinal flow path 231R1, which is located closest to the intake port 231*a*, and the most downstream-side longitudinal flow path 231R1, which is located closest to the discharge port 231*b*, are placed opposite each other on either side of the heater insertion hole 231H.

Furthermore, in the preheating block 231 of the present embodiment, the internal flow path 231R is formed either so as to run horizontally from the intake port 231*a* to the discharge port 231*b*, or so as to slope upwards towards the downstream side from the intake port 231*a* to the discharge port 231*b*. In the present embodiment, because the preheating block 231 is mounted side-on such that the longitudinal direction of the preheating block 231 is aligned in a horizontal direction, the plurality of longitudinal flow path portions 231R1 are formed extending in a horizontal direction, and the plurality of connecting flow path portions 231R2 are formed sloping vertically upwards towards the downstream side.

More specifically, in the preheating block 231 of the present embodiment, the plurality of longitudinal flow path portions 231R1 are formed at mutually different heights relative to each other, and the plurality of connecting flow path portions 231R2 are formed so as to connect together end portions in the longitudinal direction of two longitudinal flow path portions 231R1 that are mutually adjacent to each other in the height direction. In the preheating block 231 shown in FIG. 2 and FIG. 3, if the four longitudinal flow path portions 231R1 are taken in sequence from the bottom as X1, X2, X3, and X4, and the three connecting flow path portions 231R2 are taken in sequence from the bottom as Y1, Y2, and Y3, then the first connecting flow path Y1 connects together the other end portions in the longitudinal direction of the longitudinal flow path portions X1 and X2, the second connecting flow path Y2 connects together the one end portions in the longitudinal direction of the longitudinal flow path portions X2 and X3, and the third connecting flow path Y3 connects together the other end portions in the longitudinal direction of the longitudinal flow path portions X3 and X4. As a result, when the preheating block 231 is viewed from the mounting surface 231*x*, the connecting flow path portions 231R2 (Y1~Y3) are formed in a zigzag configuration moving from the intake port 231*a* towards the discharge port 231*b* (see the plan view in FIG. 3). As a consequence of this, the temperature of the liquid material flowing through the plurality of longitudinal flow path portions 231R1 (X1~X4) becomes gradually higher as the liquid material moves from the bottommost longitudinal flow path portion 231R1 towards the topmost longitudinal flow path portion 231R1. Namely, a relationship whereby [the temperature of the liquid material flowing through X1]<[the temperature of the liquid material flowing through X2]<[the temperature of the liquid material flowing through X3]<[the temperature of the liquid material flowing through X4] is established.

If the vaporization unit 2 having the above-described structure is employed, the liquid material that is introduced via the liquid material intake port P1 is preheated to a predetermined temperature as a result of flowing through the internal flow path 231R in the preheating block 231 of the preheater 23. The liquid material that is preheated by the preheater 23 is introduced intermittently into the vaporizer 21 by the ON/OFF control of the solenoid shut-off valve 22, which is serving as a supply rate controller. The liquid material is thus constantly maintained in the vaporizer 21 so that the liquid material can be vaporized without being affected by the ON/OFF control of the solenoid shut-off valve 22, and vaporized gas can thereby be generated continuously, and can be continuously discharged to the mass flow controller 3.

Next, the mass flow controller 3 will be described.

As is shown in FIG. 1, the mass flow controller 3 is provided with a flow rate detector 31 that detects the flow rate of vaporized gas flowing through the flow path, and with a flow rate control valve 32 that controls the flow rate of the vaporized gas flowing through the flow path.

The flow rate detector 31 is formed by, for example, an electrostatic capacitance-type first pressure sensor 311 that detects the pressure on the upstream side of a fluid resistor 313 that is provided on the flow path, and by, for example, an electrostatic capacitance-type second pressure sensor 312 that detects the pressure on the downstream side of the fluid resistor 313.

The flow rate control valve 32 is a control valve that controls the flow rate of the vaporized gas created by the vaporizer 21 and, in the present embodiment, is a piezo valve.

The flow rate detector 31 and the flow rate control valve 32 are mounted on a body block B2 (hereinafter, referred to as the second body block B2) that has internal flow paths (R5 and R6) formed inside it. Note that an upstream-side pressure sensor 34 and a shut-off valve 35 are provided on the upstream side of the flow rate control valve 32. In addition, a heater H2 is also provided in the second body block B2, and a downstream-side aperture of the internal flow path R6 connects to a vaporized gas discharge port P2. This second body block B2 is joined to the first body block B1 of the vaporizer unit 2 so as to form a main body block B. A housing C that houses the devices that are mounted on one surface of the main body block B is also mounted on the main body block B. Note that the symbol CN denotes a connector that is used to connect an external control device.

According to the vaporization system 100 of the present embodiment, because the internal flow path 231R and the heater insertion hole 231H are formed by machining in the preheating block 231, it is easy to reduce the size of the vaporization system, and the system can be manufactured cheaply. Moreover, because there are few manufacturing irregularities, unlike the case with conventional casting, it is possible to obtain a stable heating performance. In particular, because the internal flow path 231R has the plurality of longitudinal flow path portions 231R1 that extend in the axial direction of the heater insertion hole 231H, it is possible to effectively utilize the heat from the preheating heater 232 to heat the liquid material.

Moreover, according to the present embodiment, because the internal flow path 231R is formed by the plurality of longitudinal flow path portions 231R1 and the plurality of connecting flow path portions 231R2 as a single flow path that extends from the intake port 231*a* to the discharge port 231*b*, it is possible to increase the flow path length of the internal flow path 231R inside the preheating block 231, and to enlarge the heat exchange area where heat is exchanged with the liquid material, and to thereby improve the heating performance.

Furthermore, according to the present embodiment, because the longitudinal flow path portion 231R1 (X1) that is located furthest to the upstream side through which the comparatively low-temperature liquid material flows during the initial heating stage, and the longitudinal flow path portion 231R1 (X4) that is located furthest to the downstream side through which the comparatively high-temperature liquid material flows during the final stages of heating are located opposite each other on either side of the heater insertion hole 231H, it is possible to prevent the liquid material flowing through the most downstream side longitudinal flow path portion 231R1 (X1) being cooled by the liquid material flowing through the most upstream side longitudinal flow path portion 231R1 (X4).

In addition to this, because the discharge port 231*b* is formed above the intake port 231*a* so that the internal flow path 231R is formed either extending horizontally or sloping upwards as it moves towards the downstream side moving from the intake port 231*a* towards the discharge port 231*b*, air bubbles do not becomes trapped inside the internal flow path 231R, but are instead discharged from the discharge port 231*b* together with the liquid material that is flowing through the internal flow path 231R. As a consequence of this, the liquid material flowing through the internal flow path 231R can be efficiently heated.

Moreover, by using the preheater 23 of the present embodiment, it is possible to minimize any variations in the temperature of the storage vessel 211, so that the temperature can easily be kept constant even when liquid material is being supplied to the storage vessel (i.e., to the vaporization tank) 211. Accordingly, high flow rate vaporization can be performed stably even though the vaporizer 21 is only small in size.

In addition, the intake port 231*a* and the discharge port 231*b* can be formed by forming the longitudinal flow path portions 231R1 via machining in the longitudinal direction from the mounting surface 231*x* of the preheating block 231, so that manufacturing is made easy. Moreover, by forming the intake port 231*a* and the discharge port 231*b* in the mounting surface 231*x* of the preheating block 231, the internal flow paths R1 and R2 in the first body block B1 can be connected to the internal flow path 231R1 in the preheating block 231 simply by mounting the mounting surface 231*x* of the preheating block 231 onto the first body block B1, so that there is no need for a conduit structure to be provided.

Furthermore, in the present embodiment, by mounting the vaporizer 21 and the supply rate controller 22 onto the device mounting surface B lx of the first body block B1, the vaporizer 21 and supply rate controller 22 become connected to each other via the flow paths R1~R4 in the first body block B1. As a consequence, there is no need for any conduits to be provided between the vaporizer 21 and the supply rate controller 22, so that the size of the vaporization system 100 can be reduced. Moreover, because the vaporizer 21 and the supply rate controller 22 are each mounted on the device mounting surface B1*x*, there is no need to form a flow path inside the vaporizer 21 in order to install the supply rate controller 22, so that the structure of the vaporizer 21 can be simplified.

Note that the present invention is not limited to the above-described embodiment.

For example, in the above-described embodiment, a case is illustrated in which the longitudinal flow path portions are formed substantially in parallel with the center axis of the heater insertion hole, however, it is also possible for the longitudinal flow path portions to be formed on an inclination relative to the center axis of the heater insertion hole. In this case, in order to prevent air bubbles from becoming trapped in the internal flow path, in the same way as the connecting flow path portions of the above-described embodiment, it is desirable for the longitudinal flow path portions to be formed sloping upwards towards the downstream side. Moreover, if the longitudinal flow path portions are formed sloping upwards towards the downstream side, then the connecting flow path portions may either be formed extending in a horizontal direction, or they may be formed so as to slope upwards towards the downstream side. In addition to this, provided that the internal flow path is formed either extending in a horizontal direction, or else sloping upwards towards the downstream side between the intake port of the preheating block and the discharge port thereof, then air bubbles can be prevented from becoming trapped inside this internal flow path, and there are no particular limitations on the orientations of the longitudinal flow paths and the connecting flow paths, and a variety of arrangements are possible.

Moreover, the preheating block of the above-described embodiment has a single internal flow path, however, it is also possible for the internal flow path to be split into branches or to be merged together partway along its length, or for a plurality of mutually independent internal flow paths to be formed.

Furthermore, in the preheating block of the above-described embodiment, the longitudinal flow path portions have an intake port and a discharge port, however, it is also possible for the intake port and discharge port to be provided on other flow path portions that are connected to the connecting flow path portions or to the longitudinal flow path portions.

Furthermore, the preheating block and the storage vessel of the above-described embodiment have the general outline of a rectangular parallelepiped, however, in addition to this, they may be formed in some other type of columnar shape. For example, the preheating block may have the general outline of a circular column. Specifically, a structure may also be employed in which the preheating block 231 has the general outline of a circular column, and a flange portion is provided at one end in the longitudinal direction of this circular column shape. An end surface of this flange portion forms the mounting surface 231*x*. Through holes (i.e., clearance holes) that are used to bolt the flange portion to the device mounting surface B1*x* of the body block B1 are formed in the flange portion. By doing this, the workability of the task of mounting the preheating block 231 onto the body block B1 can be improved. Moreover, by forming the general outline of the preheating block 231 in a circular cylinder shape, the external surface area of the preheating block can be decreased, and the amount of heat discharge can accordingly be reduced.

In addition to this, the preheating block of the above-described embodiment is oriented such that the longitudinal direction thereof is aligned in a horizontal direction, however, it is also possible for it to be oriented such that the longitudinal direction thereof is aligned in an up/down direction (i.e., in a vertical direction), or in a direction that is inclined relative to the vertical direction. In this case, the heater insertion hole in the preheating block also extends in the up/down direction or in an inclined direction, and the internal flow path in the preheating block is formed so as to reciprocate either once or a plurality of times in the up/down direction, or in the inclined direction.

Moreover, in addition to a structure in which the longitudinal flow path portion located furthest to the upstream side and the longitudinal flow path portion located furthest to the downstream side are placed opposite each other on either side of the heater insertion portion, it is also possible to employ a structure in which the longitudinal flow path portion located furthest to the upstream side and the longitudinal flow path portion located furthest to the downstream side are not adjacent to each other, or a structure in which at least one midstream longitudinal flow path portion or else the heater insertion portion is positioned between the longitudinal flow path portion located furthest to the upstream side and the longitudinal flow path portion located furthest to the downstream side. Namely, in addition to a structure in which the heater insertion portion is located on a straight line connecting the longitudinal flow path portion located furthest to the upstream side and the longitudinal flow path portion located furthest to the downstream side, as is the case in the above-described embodiment, it is also possible to employ a structure in which at least one of the midstream longitudinal flow path portions is located on this same straight line. Moreover, it is also possible for the midstream longitudinal flow path portions or the heater insertion portion to not be positioned on this straight line between the longitudinal flow path portion located furthest to the upstream side and the longitudinal flow path portion located furthest to the downstream side. In this case, a structure is employed in which the midstream longitudinal flow path portions are positioned around the circumference of the heater insertion portion between the longitudinal flow path portion located furthest to the upstream side and the longitudinal flow path portion located furthest to the downstream side in the circumferential direction.

In the above-described embodiment, the internal flow path and the heater insertion portion are formed by machining, however, it is also possible, for example, to form a processing block having a heater insertion portion by casting, and to form the internal flow path in this processing block by machining.

In the above-described embodiment, the main body block B (i.e., B1 and B2) is positioned such that the longitudinal direction thereof is aligned in an up/down direction (i.e., in a vertical direction), however, it is also possible for the main body block B to be positioned such that the longitudinal direction thereof is aligned in a left/right direction (i.e., in a horizontal direction).

Furthermore, in the above-described embodiment, an example is described in which the fluid heater of the present invention is used as a preheater in a vaporization system, however, the fluid heater of the present invention can also be used as the vaporizer of a vaporization system.

In addition to this, as well as being used as a heater that heats a liquid material in a vaporization system, the fluid heater of the present invention may also be used as a liquid heater that heats other types of liquid, or as a gas heater that heats gases.

In the above-described embodiment, the main body block is formed by connecting together a first body unit and a second body unit, however, it is also possible for the main body block to be formed by a single block. In this case, the heater H1 and the heater H2 that are provided in the main body block may be formed by a single heater. By then varying the temperature inside this single heater, it is possible to perform temperature control such as making the temperature of the mass flow controller 3 side hotter than that of the vaporization unit 2 side. These temperature variations can be achieved by, for example, changing the resistance value inside the single heater. Moreover, it is also possible to perform temperature control such as making the temperature of the mass flow controller 3 side hotter than that of the vaporization unit 2 side by making the distance between the single heater and the device mounting surface on the mass flow controller 3 side different from the distance between the single heater and the device mounting surface on the vaporization unit 2 side.

Moreover, it is also possible to not provide a mass flow controller in the vaporization system of the above-described embodiment, and to only provide at least a vaporizer and a supply rate controller.

Furthermore, the vaporization system of the above-described embodiment is an integrated body in which the vaporization unit and the mass flow controller are housed in a single housing, however, it is also possible to employ a structure in which the vaporization unit and the mass flow controller are mutually independent bodies, and the vaporization unit body block and the mass flow controller body block are connected to connecting conduits.

Furthermore, it should be understood that the present invention is not limited to the above-described embodiment, and that various modifications and the like may be made thereto insofar as they do not depart from the spirit or scope of the present invention.

DESCRIPTION OF THE REFERENCE NUMERALS

100 . . . Vaporization system
2 . . . Vaporization unit
21 . . . Vaporizer
22 . . . Supply rate controller
23 . . . Preheater (Fluid heater)
231 . . . Preheating block (Heating block)
231*x* . . . Mounting surface (Longitudinal end surface)
231H . . . Heater insertion hole
231R . . . Internal flow path
231*a* . . . Intake port
231*b* . . . Discharge port
231R1 . . . Longitudinal flow path portion (Main flow path portion)
231R2 . . . Connecting flow path portion
232 . . . Preheating heater

The invention claimed is:

1. A vaporization system comprising:

a vaporizer that vaporizes a liquid material by heating the liquid material;

a supply rate controller that controls a supply rate of the liquid material to the vaporizer; and a preheater that preheats the liquid material that is supplied to the vaporizer, wherein the vaporizer, the supply rate controller, and the preheater are mounted on a device mounting surface that is set on one surface of a body block that has an internal flow path formed inside the body block, and the preheater comprising:

a heating block in which the internal flow path having an intake port through which the liquid material is introduced, in which the internal flow path and a discharge port through which the liquid material is discharged are formed, and in which a heater insertion hole that is a bottomed-hole and extends linearly in a predetermined axial direction is formed, wherein the internal flow path has a plurality of main flow path portions that have entirely rectilinear shapes, with straight sections and regular corners, and extend linearly in the predetermined axial direction, and one or a plurality of connecting flow path portions that connect the plurality of main flow path portions together at angular corners of the internal flow path, the plurality of main flow path portions are provided so as to surround the heater insertion hole, an entirety of the internal flow path is formed inside the heating block from the intake port to the discharge port, the intake port and the discharge port are formed at a first end surface in a longitudinal direction of the heating block, the heater insertion hole penetrates through a second end surface in the longitudinal direction of the heating block so that an opening of the heater insertion hole is formed at the second end surface, the first end surface serves as a mounting surface that is mounted on the device mounting surface of the body block in which the internal flow path is formed, and a heater is inserted in the longitudinal direction into the heater insertion hole towards the intake port and the discharge port from the second end surface in the longitudinal direction of the heating block.

2. The vaporization system according to claim 1, wherein, as a result of the one or the plurality of connecting flow path portions connecting together end portions in the longitudinal direction of the plurality of main flow path portions, the internal flow path is formed as a flow path that turns back on itself a plurality of times between the intake port and the discharge port.

3. The vaporization system according to claim 1, wherein either at least one main flow path portion other than a most upstream side main flow path portion, which is closest to the intake port, and a most downstream side main flow path portion, which is closest to the discharge port, or else the heater insertion hole is positioned between the most upstream side main flow path portion and the most downstream side main flow path portion.

4. The vaporization system according to claim 1, wherein the discharge port is formed above the intake port, and the internal flow path is formed so as to either extend in a horizontal direction, or so as to slope upwards as it moves towards a downstream side between the intake port and the discharge port.

5. The vaporization system according to claim 1, wherein the heating block has a generally column-shaped configuration, and one of the main flow path portions opens onto the first end surface in the longitudinal direction of the heating block so as to form the intake port, and another one of the main flow path portions opens onto the first end surface in the longitudinal direction so as to form the discharge port.

6. A vaporization system comprising:

a vaporizer that vaporizes a liquid material by heating the liquid material;

a supply rate controller that controls a supply rate of the liquid material to the vaporizer; and a preheater that preheats the liquid material that is supplied to the vaporizer, wherein the vaporizer, the supply rate controller, and the preheater are mounted on a device mounting surface that is set on one surface of a body block that has an internal flow path formed inside it, and the preheater comprising:

a heating block in which the internal flow path having an intake port through which the liquid material is introduced, in which the internal flow path and a discharge port through which the liquid material is discharged is formed, and in which a heater insertion hole that is a bottomed-hole and extends linearly in a predetermined axial direction is formed, and wherein the internal flow path has a plurality of main flow path portions that have entirely rectilinear shapes, with straight sections and regular corners, and extend in the predetermined axial direction, and one or a plurality of connecting flow path portions that connect the plurality of main flow path portions together at angular corners of the internal flow path, the plurality of main flow path portions are provided so as to surround the heater insertion hole, an entirety of the internal flow path is formed inside the heating block from the intake port to the discharge port, the intake port and the discharge port are formed at a first end surface in a longitudinal direction of the heating block, and the first end surface serves as a mounting surface that is mounted on the device mounting surface of the body block in which the internal flow path is formed.

* * * * *